US011486131B2

(12) United States Patent
Bomplitz

(10) Patent No.: US 11,486,131 B2
(45) Date of Patent: Nov. 1, 2022

(54) SHEAR FORCE ANCHOR

(71) Applicant: B.T. INNOVATION GMBH, Magdeburg (DE)

(72) Inventor: Christoph Bomplitz, Weimar (DE)

(73) Assignee: B.T. INNOVATION GMBH, Magdeburg (DE)

( * ) Notice: Subject to any disclaimer, the term of this patent is extended or adjusted under 35 U.S.C. 154(b) by 85 days.

(21) Appl. No.: 17/052,712

(22) PCT Filed: May 4, 2018

(86) PCT No.: PCT/EP2018/061459
§ 371 (c)(1),
(2) Date: Nov. 3, 2020

(87) PCT Pub. No.: WO2019/210968
PCT Pub. Date: Nov. 7, 2019

(65) Prior Publication Data

US 2021/0180316 A1 Jun. 17, 2021

(51) Int. Cl.
*E04B 1/41* (2006.01)
*E04B 1/48* (2006.01)

(52) U.S. Cl.
CPC ..... *E04B 1/4121* (2013.01); *E04B 1/41* (2013.01); *E04B 1/483* (2013.01)

(58) Field of Classification Search
CPC ..... E04C 5/12; E04B 1/483; E04B 1/4107; E04B 1/4114; E04B 1/4121; E04B 1/41
See application file for complete search history.

(56) References Cited

U.S. PATENT DOCUMENTS 1,511,542 A * 10/1924 Tomkinson ..... E04B 1/4107 52/708
4,655,015 A 4/1987 Hoyer
(Continued)

FOREIGN PATENT DOCUMENTS

CN 1657720 A 8/2005
CN 104818723 A 8/2015
(Continued)

OTHER PUBLICATIONS

China Office Action, with English translation, issued in corresponding China Application No. 201880093156.5 dated Jun. 23, 2021 (12 pages).
(Continued)

*Primary Examiner* — Andrew J Triggs
(74) *Attorney, Agent, or Firm* — Flynn Thiel, P.C.

(57) ABSTRACT

Shear force anchor for transmitting shear forces transversely to the longitudinal direction of a structural element within structural elements made primarily of concrete, comprising: a connection section for introducing at least one shear force into the shear force anchor which is connected to at least one load introduction section, which can be contacted to the structural element to transmit at least one force component in the direction of the shear force to be transmitted to the structural element. In order to transmit large shear forces while at the same time having a slim design of the structural element, the connection section is additionally spaced in the direction of the shear force to be transmitted from the load introduction section.

16 Claims, 9 Drawing Sheets

(56) References Cited

U.S. PATENT DOCUMENTS

| | | | | |
|---|---|---|---|---|
| 8,336,267 | B2 * | 12/2012 | Montague | E04B 1/4157 52/295 |
| 9,702,139 | B2 * | 7/2017 | Espinosa | B28B 23/0056 |
| 2005/0284083 | A1 | 12/2005 | Gridley et al. | |
| 2010/0107545 | A1 | 5/2010 | Montague et al. | |
| 2014/0318072 | A1 * | 10/2014 | Lee | E04B 1/4114 228/101 |
| 2015/0240493 | A1 * | 8/2015 | Lee | E04C 5/06 52/712 |

FOREIGN PATENT DOCUMENTS

| | | | |
|---|---|---|---|
| DE | 4241653 | A1 | 6/1993 |
| DE | 20012824 | U1 | 2/2001 |
| EP | 0122521 | B1 | 10/1984 |
| EP | 1477620 | A1 | 11/2004 |
| EP | 2743415 | A1 | 6/2014 |
| EP | 2907932 | A1 | 8/2015 |
| JP | 2000-248638 | A | 9/2000 |
| JP | 2003-261949 | A | 9/2003 |
| JP | 2012-507650 | A | 3/2012 |
| JP | 2016-113876 | A | 6/2016 |
| RU | 2040648 | C1 | 7/1995 |
| SU | 657138 | | 4/1979 |
| WO | 2010/051379 | A1 | 5/2010 |
| WO | 2014/058151 | A1 | 4/2014 |

OTHER PUBLICATIONS

India Office Action issued in corresponding India Application No. 202047052563 dated May 20, 2021 (6 pages).

Russia Decision to Grant, with English translation, issued in corresponding Russia Application No. 2020134751/03 dated Jun. 1, 2021 (24 pages).

International Search Report, with English translation, issued in corresponding International Application No. PCT/EP2018/061459, dated Jan. 28, 2019 (6 pages).

Written Opinion of International Searching Authority issued in corresponding International Application No. PCT/EP2018/061459, dated Jan. 28, 2019 (6 pages).

Japan Office Action, with English translation, issued in corresponding Japan Application No. 2020-561640 dated Jan. 11, 2022 (4 pages).

* cited by examiner

SHEAR FORCE ANCHOR

The present invention relates to a shear force anchor as a connection means for transmitting higher shear forces, within structural elements, transverse to the structural element direction, a connecting structure of such a shear force anchor and the structural element as well as a method for ensuring the transmission of a force in a particular direction between any two bodies through a defined section.

Fastening systems for the introduction of loads into concrete are known from concrete building which are commonly made of metal or plastic material. While dowels are predominantly used in subsequent fastening systems that are installed after concreting, the so-called inserts are dowel-type fastening systems or anchoring rails with head bolts and other more complex shapes. The term "insert" results from the manufacturing process, since they are inserted attached to the formwork before concreting.

For example, EP 2 743 415 A1 shows an expansion joint construction element, wherein at side walls respectively orientated vertically in the installed position of a heavy-duty dowel and a bearing sleeve double-headed bolts are fitted.

EP 2 907 932 A1 discloses an anchor channel, to which a sub-anchor is provided in order to increase the resistance against shear loads.

EP 1 477 620 A1 shows a fixing element for embedding with an end section in a concrete element and for absorbing transverse forces, wherein partial surfaces are provided on the end section that can be aligned in the direction of the transverse forces to be absorbed, which partial surfaces comprise, in relation to this direction, a front and a rear partial surface that is arranged offset to it, and the rear partial surface is provided with a padding.

Load-bearing means in the form of anchors for precast concrete elements are further known, for example, from prior art with reference to FIG. 1 of document EP 0 122 521 B1.

These anchors are encased in concrete in precast concrete elements and loaded in the structural element by tensile and shear forces. To dissipate the loads, the anchor calculations are dimensioned and integrated accordingly. These anchors are typically installed centrally in relation to the structural element thickness, since the anchors are positioned there most expediently with respect to any load. To absorb tensile loads, the anchors are provided with bolts or bear, for example, corrugated steel anchors. Due to the resulting undercuts, these anchors are anchored in the concrete and secured against tearing out under tensile load.

However, tensile load often does not represent the critical load case for such anchors, but rather shear forces acting at a right angle to the tensile forces. At introduction of shear force until concrete failure concrete break-out cones are formed, starting out from these anchors. Based on a shear force introduced through the anchor, a so-called break-out cone forms in the direction of force at an angle of 60° towards the structural element edge. The safety concept against this concrete edge fracture provides that the anchor is disposed at a sufficient edge distance to the defining structural element edge. These edge distances to be met are dominated by the shear forces, which leads to the fact that they largely determine the structural element thickness, where with increasing structural element thickness, the failure load can be increased and the absorbable shear force can be increased.

The problem of transmitting large shear forces while at the same time having a slim design therefore arises.

The present invention has been devised in view of the above-mentioned problem. An object is therefore to provide a connection means for transmitting higher shear forces which allows the use of structural elements having a slim design.

For increasing the absorbable shear force, it is desirable to use a larger part of the structural element thickness in order to transmit the acting loads to the structural elements. In the event of failure, the fracture cone therefore increases, for which reason it has to overcome a greater resistance, which increases the failure load.

Based on this consideration, a shear force anchor having the features of claim 1 is provided to solve the problem described above.

For this purpose, a shear force anchor for transmitting shear forces transversely to the longitudinal direction of a structural element within structural elements made primarily of concrete is therefore provided according to a first aspect of the invention as a connection means, comprising: a connection section for introducing at least one shear force into the shear force anchor which is connected to at least one load introduction section, which can be contacted to the structural element to transmit at least one force component in the direction of the shear force to be transmitted to the structural element, characterized in that the connection section is spaced in the direction of the shear force to be transmitted from the load introduction section.

With a shear force anchor according to the first aspect of the invention, at least one shear force can be introduced into the shear force anchor via the connection section. Via the load introduction section the shear force can not only be transmitted directly at the connection section to the structural element, but additionally at least in part at the load introduction section, where the load introduction section is in direct contact with the structural element and transmits at least one component in the direction of the shear force to be transmitted. Conversely, since the connection section is spaced in the direction of the shear force to be transmitted from the load introduction section, the load introduction section is spaced in a direction opposite to the direction of the shear force to be transmitted from the connection section. If such a shear force anchor is inserted into the structural element in such a manner that a distance from the load introduction section in the direction of the shear force to be transmitted along the structural element thickness direction up to the structural element edge is as large as possible, then a large part of the structural element thickness is available at least for the force component transmitted through the load introduction section in the direction of the shear force for forming the fracture cone. This leads to an increase in the failure load.

Preferably, the shear force anchor comprises two load introduction sections for transmitting opposite shear forces, where the first load introduction section can transmit a force component to the structural element in one direction of the shear forces to be transmitted, and the second load introduction section can transmit a force component to the structural element in the other direction of the shear forces to be transmitted and is spaced in the one direction of the shear forces to be transmitted from the first load introduction section, and where the connection section is connected to both load introduction sections.

Such a shear force anchor is ideally suited for transmitting opposite or alternating shear forces, where a load introduction section transmits the shear force, at least components thereof, in the one direction and the other transmits the shear force, at least components thereof, in the other direction.

Since the two load introduction sections are connected to one another, the opposite shear forces can be introduced into the shear force anchor via one connection section and transmitted from the respective load introduction section to the structural element. Due to the fact that the second load introduction section is spaced in the one direction of the shear forces to be transmitted from the first load introduction section, a large structural element thickness is available for the transmission of the respective force component in the direction of the shear force respectively to be transmitted through the respective load introduction section.

The shear force anchor additionally comprises at least one load introduction prevention section, which in part, and preferably entirely, prevents force transmission with a component in the direction of the shear force respectively to be transmitted through the respective load introduction section to the structural element.

Since a load introduction prevention section is additionally provided which is configured such that it transmits almost no force component in the direction of the respective shear force to be transmitted to the structural element, the shear force can be transmitted to the structural element largely only at the defined section of the load introduction section. The load introduction prevention section therefore causes the force component transmitted at the respective load introduction section in the direction of the shear force respectively to be transmitted to be increased. Therefore, a large force component in the direction of the shear force respectively to be transmitted is transmitted to the structural element over a large structural element thickness.

Furthermore, the load introduction prevention section can be provided in sections at the respective load introduction section and is provided at least in sections at the connection section. As a result, transmission of a large force component in the direction of the shear force respectively to be transmitted to the structural element through the connection section is prevented, and the transmission of the shear force through the respective load introduction section takes place in a defined region of the respective load introduction section.

According to another aspect of the invention, the load introduction prevention section can be provided spaced in the direction of the shear force to be transmitted from the respective load introduction section.

By providing the load introduction prevention section spaced in the direction of the shear force to be transmitted from the respective load introduction section, it can be reliably ensured that a large structural element thickness is utilized for transmitting the respective shear force to the structural element. Since the load introduction prevention section is provided forward of the respective load introduction section in the direction of the shear force, according to the above described installation position, a smaller part of the structural element thickness is available from the respective load introduction prevention section in the direction of the shear force to be transmitted than from the respective load introduction section. Since the shear force is largely transmitted via the load introduction section to the structural element, a large part of the structural element thickness is utilized for transmitting the shear force.

A further aspect of the invention provides that the force component to be transmitted from the respective load introduction section to the structural element in the direction of the shear force respectively to be transmitted can be greater than the force component to be transmitted from the load introduction prevention section to the structural element in the direction of the shear force respectively to be transmitted.

Accordingly, the transmission of the respective shear force to the structural element takes place predominantly through the respective load introduction section. Although the load introduction prevention section may be able to transmit a force component in the direction of the shear force, it is always smaller than the force component in the direction of the shear force transmitted through the load introduction section to the structural element. This can achieve that, according to the above installation position of the shear force anchor in the structural element, where the distance from the respective load introduction section in the direction of the shear force to be transmitted along the structural element thickness direction up to the respective structural element edge is as large as possible, the largest structural element thickness is available for the largest component in the direction of the shear force to be transmitted.

A further aspect of the invention provides that the respective load introduction section can comprise at least one load introduction surface, which can be contacted to the structural element and whose surface normal pointing away exhibits a component in the direction of the shear force respectively to be transmitted.

This ensures that the force transmission to the structural element through the load introduction section is two-dimensional, where the shear force can be introduced more uniformly and stress peaks can thus be avoided. The load introduction surface with a surface normal pointing away, which is the normal of the load introduction surface facing away from the respective load introduction surface of the respective load introduction section, having a component in the direction of the shear force respectively to be transmitted, causes a compressive stress in the structural element. The failure form can be selectively brought about by a break-out cone, which arises transversely to the structural element longitudinal direction in the event of compressive stress.

According to a further aspect of the invention, the several load introduction surfaces of the respective load introduction section can be arranged in one plane. The load introduction surfaces of the respective load introduction section are preferably perpendicular to the direction of the shear force respectively to be transmitted.

With load introduction surfaces being disposed in one plane, easy fabrication of the shear force anchor can be ensured. Furthermore, a more uniform load on the structural element is obtained. If, in addition, the load introduction surfaces of the respective load introduction section are perpendicular to the direction of the shear force respectively to be transmitted, then the shear force vector and the surface normal vector of the load introduction surface are in parallel, which promotes the formation of a fracture cone. The structural element is there under pure compressive stress transversely to the structural element longitudinal direction by the component of the shear force transmitted by the load introduction surfaces of the respective load introduction section. Therefore, no shear occurs at the boundary between the load introduction surface and the structural element.

According to a further aspect of the invention, the load introduction prevention section can be provided at least in sections on all surfaces which are located from the load introduction surfaces of the respective load introduction section in the direction of the shear force respectively to be transmitted and whose surface normals pointing away exhibit a component in the direction of the shear force respectively to be transmitted. In this way, a large component of the shear force can be selectively introduced into the structural element over a large structural element thickness, since force transmission with a component in the direction of the shear force to be transmitted to the structural element is in part, and preferably entirely, prevented on all surfaces which in the direction of the shear force to be transmitted are located forward of the load introduction surfaces of the respective load introduction section and whose surface normal pointing away exhibit a component in the direction of the shear force respectively to be transmitted. The formation of the fracture cone therefore takes place reliably from the load introduction surfaces of the respective load introduction section, and with the greatest possible distance from the structural element edge.

The load introduction prevention section is preferably provided on all surfaces except on the load introduction surfaces of the respective load introduction section.

The transmission of force in the direction of the shear force can then be effected even more reliably at the load introduction surfaces of the respective load introduction section. Furthermore, a shear force anchor provided with a large-area load introduction prevention section can further reduce sound transmission or vibration.

A further aspect of the invention provides that a web can extend from the connection section on both sides which establishes the connection to the respective load introduction section.

Since the connection section is provided between the two load introduction areas, no additional installation space must be provided for the connection section in the structural element. The shear force respectively to be transmitted is led via the webs to the respective load introduction section, where the web represents a structurally simple form of the connection between the connection section and the load introduction sections.

Furthermore, the connection section is a sleeve.

The sleeve allows easy attachment of connection elements for introducing forces into the shear force anchor. For example, connection elements can be screwed into the sleeve by way of a thread. If the axis of the sleeve runs preferably in the structural element longitudinal direction perpendicular to the shear forces to be transmitted, a bolt for the introduction of load into the shear force anchor as well as an anchor bolt for anchoring tensile forces in the structural element can be attached in the sleeve.

If the axis of the sleeve is aligned in the structural element longitudinal direction, tensile and compressive forces in the structural element longitudinal direction can also be easily introduced into the shear force anchor through the load introduction bolt. The load introduction bolt can be attached to the sleeve from one direction, where the anchor bolt can be attached to the sleeve from the opposite direction. The anchor bolt prevents from tearing out in the structural element longitudinal direction with tensile load in the structural element longitudinal direction.

According to a further aspect of the invention, the load introduction prevention section can be made of compressible elastic material, preferably closed cell foam.

The load introduction prevention section can therefore deform elastically in the direction of the shear force under the acting shear force, and a spring effect arises due to this elastic deformation, due to which the shear force is transmitted to the structural element only to a very small extent. Compressible material also allows for deformations under compressive stress of the load introduction prevention section when the load introduction preventing section is surrounded by concrete on all sides, whereby transverse elongations are prevented.

A further aspect of the invention provides that the connection section, the webs and the respective load introduction sections can be made of more rigid material than that of the load introduction prevention section, preferably made of galvanized steel.

The load introduction surfaces, being more rigid than the load introduction prevention section, then leads to a connection of the load introduction surfaces of the load introduction sections to the structural element that is more rigid under compressive stress than the connection to the structural element via the load introduction prevention section, where the shear force to be transmitted is transmitted to the structural element largely via this rigid connection and only to a very small extent via the elastically resilient load introduction prevention section. The principle is there taken advantage of that, when a force can be transmitted in one direction at several sections to a structural element, then the majority of the force is transmitted at the connection with the greatest rigidity. The galvanized steel also allows for good corrosion protection.

Furthermore, one aspect of this invention provides a connection structure consisting of a structural element and a shear force anchor according to the invention, where the load introduction prevention section can at least in part be provided as a gap between the structural element and the shear force anchor.

Elastic material can then be dispensed with in part or entirely and weight and material can be saved. If a gap is present, then no component in the direction of the shear force is transmitted at all to the structural element in the region of the gap. In the regions in which the gap is to be provided, a support structure, such as a core, is to be provided during concrete casting, which keeps the concrete at a distance. This support structure can then be removed after casting, for example by etching. For forming a gap, the shear force anchor can alternatively be provided with a dissolving material which dissolves after concrete casting.

Furthermore, the present disclosure relates to a method for ensuring the transmission of a force in a particular direction between any two bodies through a defined load introduction section, where the one body comprises the defined load introduction section via which it is in contact with the other body and the load introduction section can transmit a force component in the direction of the force in the particular direction to the other body, and in the one body, all sections, with the exception of the load introduction section, which can transmit a force component in the direction of the force in the particular direction to the other body, are provided with a layer that covers these sections and is easily deformable in comparison to the load introduction section and are in contact with the other body via this layer, where, upon applying load to the one body through the force in the particular direction, the deformable layer deforms and thereby the force in the particular direction is transmitted with a smaller component than through the load introduction section to the other body.

This method describes the above-mentioned principle that, when a force can be transmitted in one direction at several sections to a structural element, then the majority of the force is transmitted at the connection with the greatest rigidity. Due to the fact that the deformable layer deforms more easily than the load introduction section, more specifically than the attachment of the load introduction section to the other body, a large part of the force in the particular direction is transmitted to the other body through the load introduction section. The shear force anchor according to the invention, which is described in more detail with the following drawings, is based on this principle.

DETAILED DESCRIPTION OF THE DRAWINGS

Figure 10:
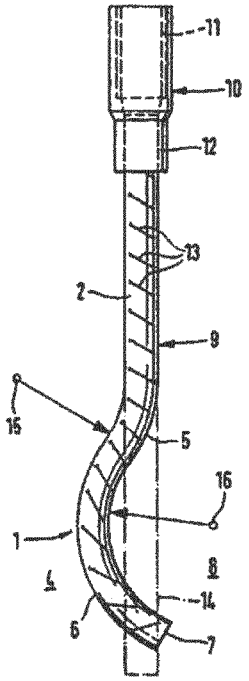
Fig. 10 prior art
FIG. 10 shows an anchor according to prior art.
Figure 11:
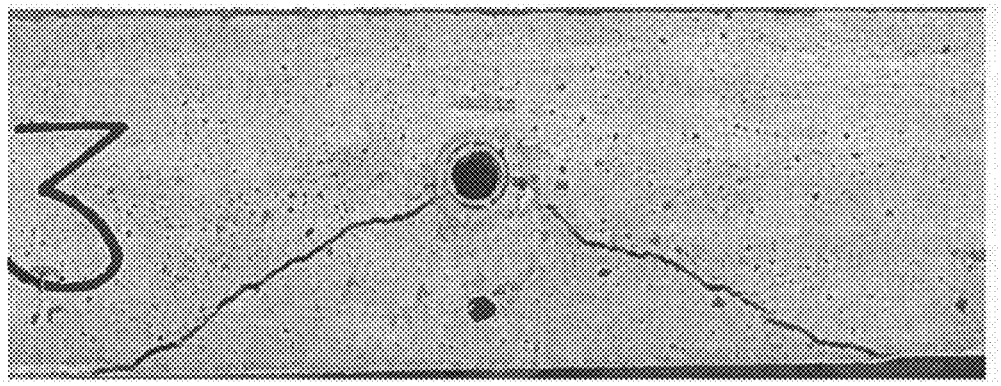
Fig. 11 prior art
FIG. 11 shows an illustration of a break-out cone of a conventional bolt anchor.

With the anchors known from prior art according to FIG. 10, a break-out cone as shown in FIG. 11 arises in the event of failure due to shear force. The safety concept against this concrete edge break intends that the anchor be disposed at a sufficient edge distance to the defining structural element edge. These edge distances to be met are dominated by the shear forces, which leads to the fact that they largely determine the structural element thickness, where, with increasing structural element thickness, the failure load can be increased and the absorbable shear force can be increased. In order to ensure a sufficient failure load, structural elements with a large structural element thickness are therefore frequently provided, in particular with changing or opposite shear forces.

Figure 12:
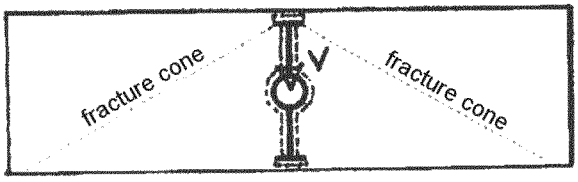
FIG. 12 shows a view of the resulting fracture cone in accordance with the theoretical assumption of the shear force anchor according to the invention.

The inventors of this application have recognized that the structural element thickness can be reduced even with oppositely acting shear forces, if a larger part of the structural element thickness is used to introduce the acting loads into the structural elements. In the event of failure, the break-out cone therefore enlarges, for which reason it has to overcome a greater resistance, which increases the failure load. This principle is shown in FIG. 12, where an acting shear force V can be introduced almost over the entire structural element thickness. This principle is realized by a connection means in the form of a shear force anchor, which shall be described in more detail below. Terms such as "right-hand", "left-hand", "top", "bottom", "first" or "second" are not meant to be restrictive, but are used merely for the purpose of distinguishing similar sections.

Figure 1A:
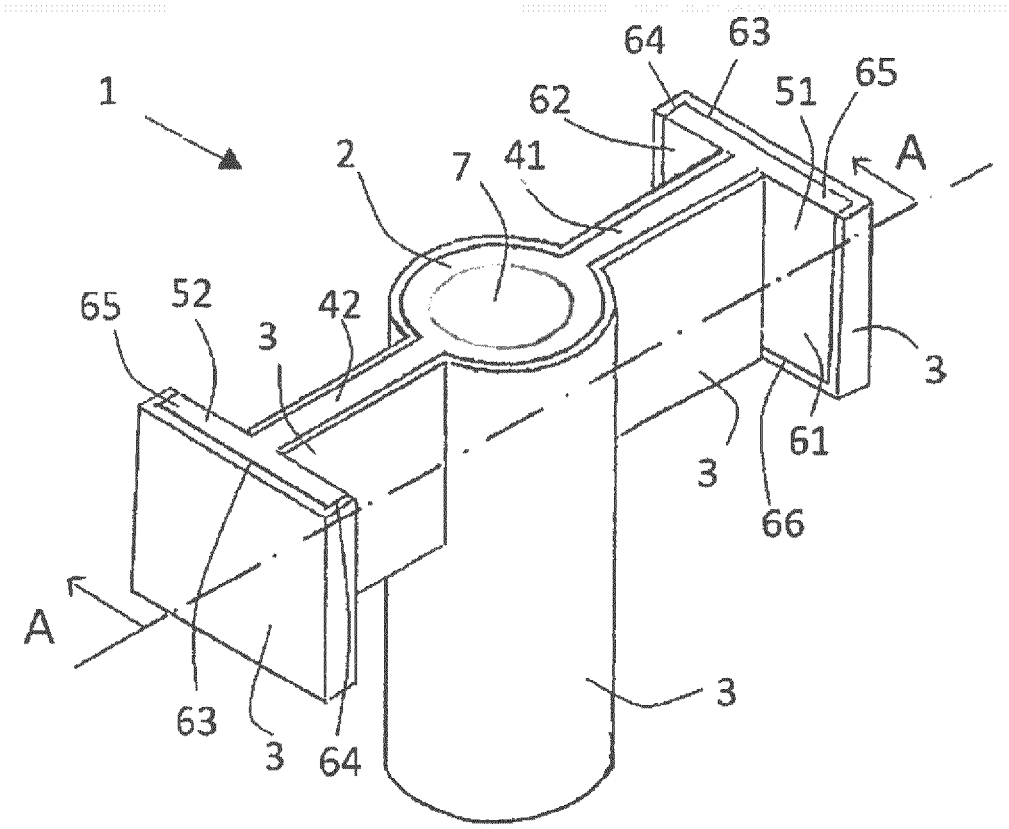
FIG. 1*a* shows a perspective view of the shear force anchor (1) according to the invention in a first embodiment with the load introduction prevention section (3)
Figure 1B:
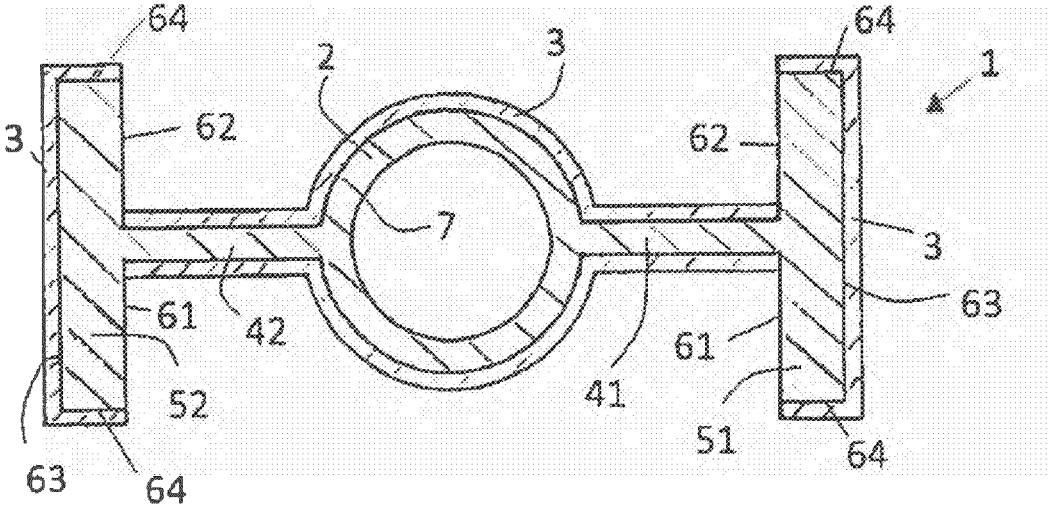
FIG. 1*b* shows a sectional view of the shear force anchor according to the invention of the first embodiment with the load introduction prevention section (3)
Figure 2:
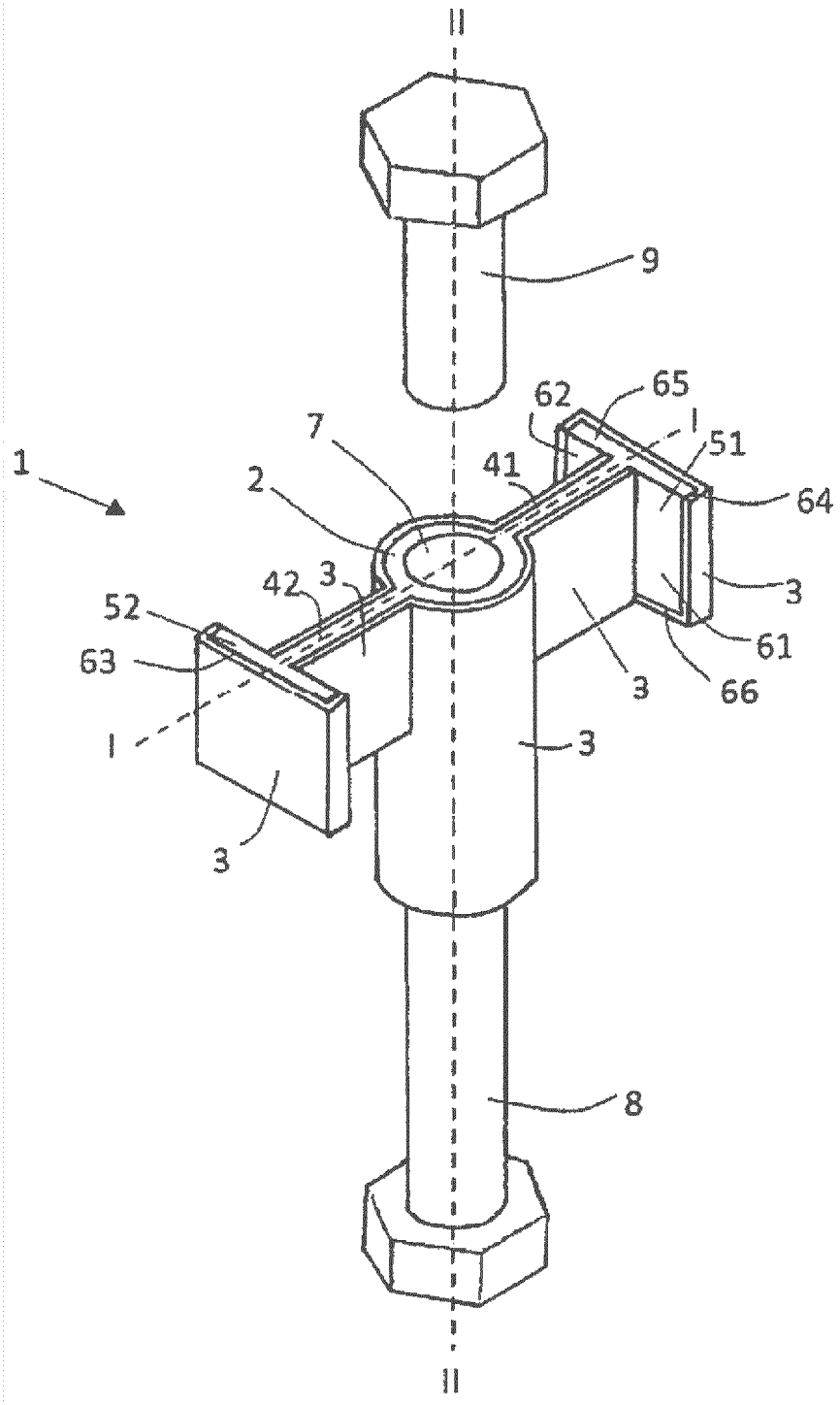
FIG. 2 shows a perspective view of the shear force anchor (1) according to the invention of the first embodiment with the load introduction prevention section (3), the anchor bolt (8) and the load introduction bolt (9)

FIG. 1*a* shows a perspective view of shear force anchor 1 according to the invention in a first embodiment for transmitting higher shear forces primarily for structural elements 10 with small structural element thicknesses. FIG. 1*b* shows shear force anchor 1 in a sectional view, where the section is drawn from the dotted line along the arrows A. Shear force anchor 1 according to the invention comprises a connection section 2 through which forces can be introduced into the shear force anchor. At least one shear force should be able to be introduced into shear force anchor 1 through the connection section. Furthermore, shear force anchor 1 comprises load introduction sections 51 and 52 on both sides of connection section 2 for transmitting alternating or opposite shear forces into the structural element 10, namely, a first right-hand side cuboid load introduction section 51 for transmitting a force component in one direction of the opposite shear forces to be transmitted to structural element 10 and a second left-hand side cuboid load introduction section 52 for transmitting a force component in the other direction of the shear forces to be transmitted to structural element 10. Load introduction sections 51 and 52 are connected to connection section via webs 41 and 42 which extend on both sides of connection section 2. Each of the two load introduction sections 51 and 52 comprises a first rectangular load introduction surface 61 and a second rectangular load introduction surface 62. Load introduction sections 51 and 52 are in addition to load introduction surfaces 61 and 62 each further formed by the surfaces arising in the creation of load introduction surfaces 61 and 62. As shown in FIGS. 1*a* and 1*b*, in the case of cuboid load introduction sections 51 and 52, these are rear surface 63 of load introduction surfaces 61 and 62, two side surfaces 64, upper surface 65 in FIG. 1*a*, and lower surface 66 in FIG. 1*a*. A dumbbell-shaped appearance of shear force anchor 1 then arises. A load introduction prevention section 3 is provided on shear force anchor 1 over a large area, but not at load introduction surfaces 61 and 62 and upper surface 65 of load introduction sections 51 and 52 and the adjoining upper surface of the webs. At load introduction sections 51 and 52 load introduction prevention section 3 is provided on the rear side 63 of respective load introduction surfaces 61 and 62, i.e., on a surface of the side facing away of load introduction surfaces 61 and 62. Furthermore, the load introduction prevention section is also attached to the side surfaces of the shear force anchor along the axis I-I, as shown in FIG. 2, both to side surfaces 64 of load introduction sections 51 and 52 as well as to the side surfaces of webs 41 and 42, and to lower surfaces 66 of load introduction sections 51 and 52 as well as to the lower surfaces of webs 41 and 42. Load introduction prevention section 3 in part, but preferably entirely, prevents force transmission with a component in the direction of the shear force to be respectively transmitted through load introduction sections 51 and 52. The term component is used because the shear force to be transmitted can also be transmitted only largely through load introduction sections 51 and 52, and a small part can also be transmitted through load introduction prevention section 3. In any case, the force component in the direction of the shear force respectively to be transmitted to be transmitted from respective load introduction section 51 and 52 to structural element 10 is greater than the force component in the direction of the shear force to be transmitted from load introduction prevention section 3 to the structural element, preferably at least 20 times as great.

The mode of action of the shear force anchor according to the invention of the first embodiment shall be explained with reference to FIGS. 2 and 3.

Connection section 2 in the first embodiment shown is configured as a sleeve comprising an internal thread 7. As shown in FIG. 2, shear force anchor 1 according to the invention can be employed in combination with anchor bolt 8 and load introduction bolt 9, where anchor bolt 8 and load introduction bolt 9 are screwed into internal thread 7 of shear force anchor 1. Tensile, compressive and shear forces can then be transmitted to shear force anchor 1 according to the invention. Via load introduction bolt 9, primarily tensile forces acting along the structural element longitudinal axis or axis II-II, which is the axis of the sleeve as well as of load application bolt 9 and anchor bolt 8, are transmitted via shear force anchor 1 to oppositely disposed anchor bolt 8 and anchored in structural element 10. For introducing tensile forces, load introduction prevention section 3 is not provided on anchor bolt 8. For particularly efficient transmission of compressive forces, anchor bolt 8 and load introduction bolt 9 can be screwed into the sleeve far enough that they meet in a positive-fit manner in the sleeve.

Figure 3:
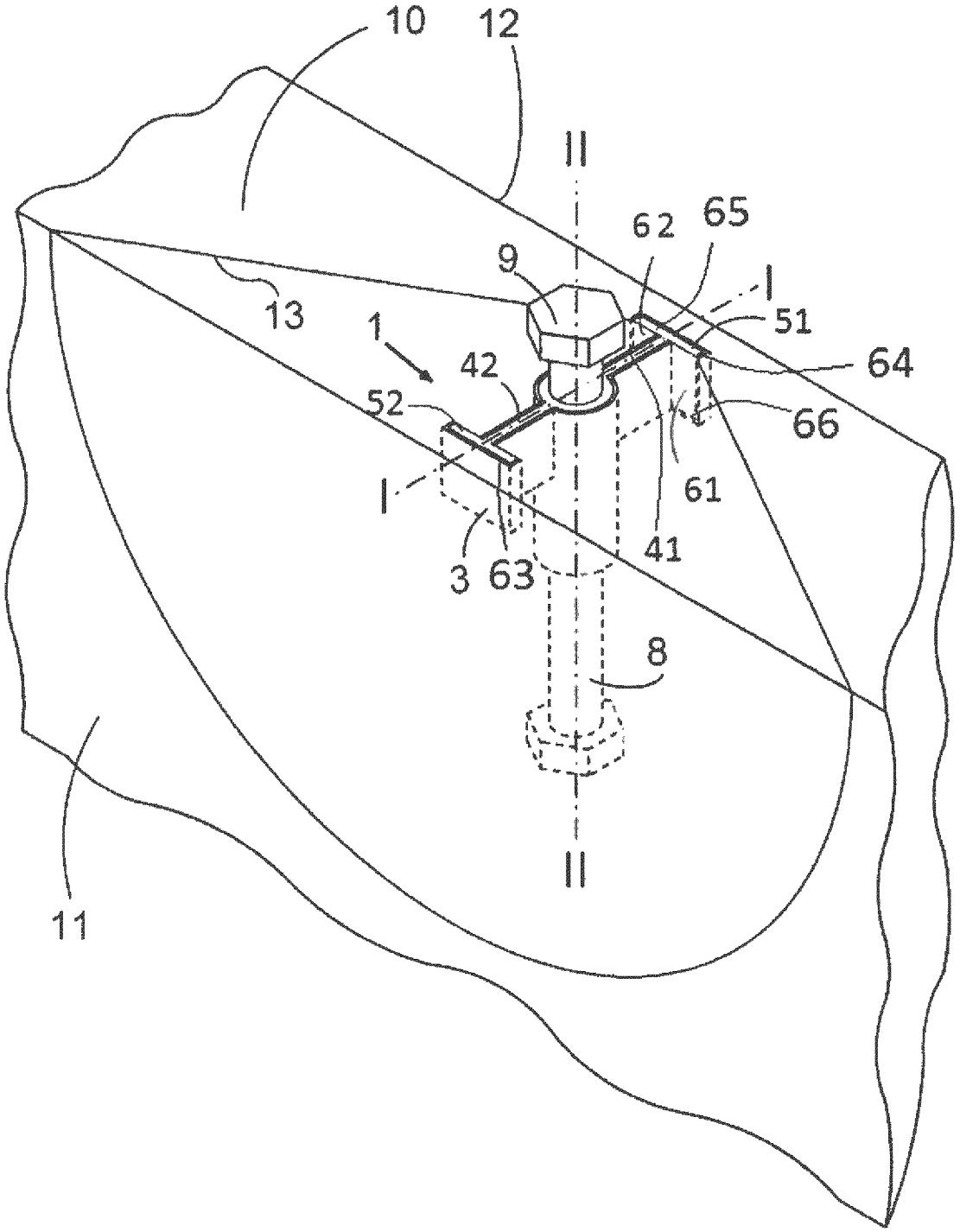
FIG. 3 shows a perspective view of the shear force anchor (1) according to the invention of the first embodiment with the load introduction prevention section (3) within the structural element (10)

For the introduction of tensile forces into structural element 10, it is desirable that axis II-II, i.e. the axis of the sleeve, of load introduction bolt 9 and of anchor bolt 8, runs as centrally as possible between the two structural element outer surfaces 11 and 12, as shown in FIG. 3, in the structural element longitudinal direction, since a large edge distance is thus obtained on either side. According to prior art anchors, shear forces introduced through load introduction bolt 9 into connection section 2 and acting along axis I-I, which is perpendicular to axis II-II, would be introduced into the structural element through the surfaces forming the connection section, and therefore be introduced into the structural element very close to axis II-II. However, only an insufficiently small area of the structural element thickness between the two outer surfaces 11 and 12 is then utilized, which restricts the failure load in the event of shear force failure. With shear force anchor 1 according to the invention, shear forces can be transmitted through sections which are closer to structural element outer surfaces 11 and 12 and therefore spaced from connection section 2. A large portion of the structural element thickness between outer surfaces 11 and 12 can therefore be utilized. In the case of the shear force anchor according to the invention, the sections for the introduction of shear forces, which are located close to the structural element outer surfaces 11 and 12, are load introduction sections 51 and 52 which are respectively spaced in the direction of the shear force respectively to be transmitted from connection section 2. Load introduction sections 51 and 52 at least in part overlap connection section 2 along the direction of the shear force respectively to be transmitted. In shear force transmission, none or only very small moments act on the shear force anchor.

Load introduction sections 51 and 52 are configured such that they can transmit a force component in the direction of the shear force to be transmitted into the structural element. It is also possible to transmit the shear force by pure shear stress to the structural element when a sufficiently shear-resistant connection of the load introduction section to the structural element is provided. Preferably, however, as shown in FIGS. 1*a*-3, the load introduction sections comprise load introduction surfaces 61 and 62 which in the embodiment shown are perpendicular to the direction of the shear force to be transmitted along axis I-I. The shear force anchor is arranged such that axis II-II extends in the structural element longitudinal direction and axis I-I transverse thereto in the structural element thickness direction. Load introduction surfaces 61 and 62 are perpendicular to axis I-I and therefore perpendicular to the shear force to be transmitted. The structural element is under compressive stress transversely to the structural element longitudinal direction in the direction of the shear force to be transmitted, which causes the formation of a break-out cone. In FIG. 3, the region of the structural element extending from load introduction surfaces 61 and 62 of load introduction section 51 at the right-hand side to the structural element outer surface 11 at the left-hand side is under compressive stress by a shear force acting in the direction of axis I-I and directed toward structural element outer surface 11. In the case of failure, illustrated break-out cone 13 arises. The embodiment shown, where load introduction surfaces 61 and are perpendicular to the direction of the shear force to be transmitted along axis I-I, is a preferred embodiment. However, it is also conceivable that shear force introduction occurs through surfaces on load introduction section 51 or 52, respectively, whose surface normals pointing away exhibit only one component in the direction of the shear force to be transmitted. The surface normal pointing away there is the surface normal which points away from the respective surface of load introduction section 51 or 52. It is therefore possible that the surface normal of a load introduction surface pointing away forms an angle with the direction of the shear force to be transmitted, or in other words, the load introduction surfaces need not necessarily be perpendicular to the direction of the shear force to be transmitted, but can also extend obliquely thereto. The structural element would then not only be under compressive stress transversely to the structural element longitudinal direction due the shear force to be transmitted, but also under shear stress. Therefore, any surface whose surface normal facing away exhibits a component in the direction of the shear force to be transmitted can act as a load introduction surface. It is also conceivable to transmit the shear force not in a two-dimensional manner but in a linear or punctiform manner from the load introduction sections to structural element 10. In the embodiment shown, load introduction surfaces 61 and 62 are located, among those surfaces whose surface normal pointing away exhibits a component in the direction of the shear force respectively to be transmitted, furthest in a direction opposite to the direction of the shear force respectively to be transmitted through them. A large portion of the structural element thickness between outer surfaces 11 and 12 can therefore be utilized.

In order for the shear force to be introducible largely (with a large component) from load introduction surfaces 61 and 62 of respective load introduction sections 51 and 52 into the structural element, the introduction of the shear force through other sections, which would be capable of introducing a force component in the direction of the shear force to be transmitted into the structural element 10, is preferably to be prevented. For this purpose, load introduction prevention section 3 is provided on shear force anchor 1 of the first embodiment, as shown in FIGS. 1*a*-3, at all sections which could introduce a force component in the direction of the shear force to be transmitted into structural element 10, with the exception of load introduction surfaces 61 and 62 of the two load introduction sections 51 and 52, such that the surfaces of these sections are entirely covered by load introduction prevention section 3. In particular, load introduction prevention section 3 is provided on connection section 2 and in sections, with the exception of load introduction surfaces 61 and 62, on load introduction sections 51 and 52. According to FIG. 3, load introduction prevention section 3 is provided spaced in the direction of the shear force respectively to be transmitted from respective load introduction sections 51 and 52. A shear force, which acts in the direction of axis I-I and is directed toward structural element outer surface 11, can be transmitted into structural element 10 through load introduction surfaces 61 and 62 of load introduction section 51. Load introduction prevention section 3 is provided inter alia at connection section 2, which is spaced in the direction of the shear force to be transmitted through load introduction section 51, as well as on surface 63 of second load introduction section 52, facing structural element outer surface 11, which is spaced in the direction of the shear force to be transmitted through load introduction section 51 from first load introduction section 51. In particular connection section 2 as well as surface 63 of second load introduction section 52 facing structural element outer surface 11 are located in a direction of the shear force to be transmitted through load introduction section forward of load introduction section 51, and without the load introduction prevention section provided thereon would be suited to transmit a large component in the direction of the shear force to be transmitted through load introduction section 51 to structural element 10. Because, connection section 2 as well as surface 63 of second load introduction section 52 facing structural element outer surface 11 comprise surface normals pointing away which exhibit a component in the direction of the shear force to be transmitted through load introduction section 51. As a result, structural elements 10 would also be loaded by these sections with a large force component in the direction of the shear force to be transmitted through load introduction section 51. As can be seen in FIG. 3, shear force anchor 1 is mounted in the structural element in such a manner that a spacing as large as possible arises from load introduction section 51 in the direction of the shear force to be transmitted through load introduction section 51 along the structural element thickness direction up to structural element edge 11, where connection section 2 and surface 63 of second load introduction section 52 facing structural element outer surface 11 are then located in the direction of the shear force to be transmitted through load introduction section 51 forward of load introduction section 51. Load introduction prevention section 3 spaced in the direction of the shear force to be transmitted through load introduction section 51 prevents in part, but preferably entirely a force transmission with a component in the direction of the shear force to be transmitted through load introduction section 51 through the shear force anchor in all sections which are located in the direction of the shear force to be transmitted through load introduction section 51 forward of load introduction section 51. A large part of the structural element thickness can therefore be utilized for transmitting a large component in the direction of the shear force to be transmitted through load introduction section 51.

An undesired load transfer by the shear forces acting along axis I-I is therefore prevented by load introduction prevention section 3, so that the shear force respectively to be transmitted is hung back against the acting direction through respective web 41 or 42 and transmitted selectively to structural element 10 via load introduction surfaces 61 and 62 arranged there at load introduction sections 51 and 52. The formation of break-out cone 13 in the acting direction of the shear force then takes place only from these load introduction surfaces 61 and 62. Based on this geometric principle, the absorbable shear force is increased because the decisive edge distance to the lateral outer surfaces of structural element 11 and 12 is effectively increased. As shown in FIG. 3, respective load introduction surfaces 61 and 62 of the two load introduction sections 51 and 52 are arranged in cross-sections transverse to the structural element longitudinal direction on a side that is located from structural element edge 11 and 12 opposite to the direction of the shear force respectively to be transmitted. Therefore, a large part of the structural element thickness can be utilized for both directions of the opposite shear forces to be transmitted to transmit a large component in the direction of the shear force respectively to be transmitted.

However, the load introduction prevention section 3 need not be provided at all sections which can introduce a force component in the direction of the shear force to be transmitted into structural element 10, with the exception of load introduction surfaces 61 and 62 of the two load introduction sections 51 and 52. For an introduction of the shear force over as large a part of the structural element thickness as possible, however, the load introduction prevention section is preferably at least in sections provided on all surfaces which are located from the load introduction surface in the direction of the shear force respectively to be transmitted and whose surface normals pointing away exhibit a component in the direction of the shear force respectively to be transmitted, such as, for example, surface 63 of second load introduction section 52 facing component outer surface 11, since these surfaces without load introduction prevention section 3 would be particularly suitable to transmit a large component in the direction of the shear force to be transmitted to structural element 10. The reason for this being that these surfaces cause a compressive stress in the structural element, with which a large component can be transmitted in the direction of the shear force respectively to be transmitted to structural element 10. Other surfaces whose surface normals pointing away have no component in the direction of the shear force respectively to be transmitted would not transmit any force component in the direction of the shear force without specific connection to structural element 10 anyway. Load introduction prevention section 3 can be in sections attached to the surfaces described above or even omitted altogether as long as the force component to be transmitted from respective load introduction section 51 and 52 to structural element 10 in the direction of the shear force respectively to be transmitted is the largest force component to be transmitted in the direction of the shear force respectively to be transmitted.

The shear force anchor shown in FIGS. 1*a*-3 is suitable for transmitting alternating or opposite shear forces, because it comprises two load introduction sections 51 and 52 with the respective load introduction surfaces 61 and 62. For load introduction of a shear force acting along the axis I-I and directed to left-hand outer surface 11, it is advantageous by load introduction surfaces 61 and 62 of the right-hand load introduction section 51, that load introduction prevention section 3 is at least in sections provided on the surfaces of second left-hand load introduction section 52 whose surface normals pointing away exhibit a component in the direction of this acting shear force. The same applies to the surfaces of right-hand load introduction section 51, whose surface normals pointing away exhibit a component in the other direction of the shear force to be transmitted, when a shear force directed to right-hand outer surface 12 is to be transmitted. Also, load introduction surfaces 61 and 62 of the two load introduction sections 51 and 52 need not be parallel to each other as long as each load introduction section 51 and 52 can introduce a component in the direction of the shear force respectively to be transmitted into the structural element. For example, load introduction surfaces 61 and 62 of left-hand load introduction section 51 can extend in an oblique manner relative to axis I-I. Load introduction surfaces 61 and 62 are preferably provided on both load introduction sections 51 and 52, the surface normals of which exhibit a component in the direction of the respective opposite shear forces to be transmitted. Hence, the respective surface normals pointing away of load introduction surfaces 61 and 62 of two load introduction sections 51 and 52 for transmitting opposite shear forces preferably have components directed towards each other. The embodiments shown represent shear force anchors having two load introduction sections 51 and 52 for transmitting opposite shear forces, where one load introduction section 51 can transmit a force component in one direction of shear forces to be transmitted to the structural element, and second load introduction section 52 can transmit a force component in the other direction of the shear forces to be transmitted to the structural element. However, if a shear force has to be transmitted only in one direction, then only one load introduction section 51 can be provided.

Load introduction prevention section 3 is configured such that it can deform in the direction of the shear force when subjected to the acting shear force, where load introduction prevention section 3 is preferably elastically deformed and a spring effect arises which transmits the shear force to the structural element only to a very small extent. As described above, load introduction prevention section 3 is preferably attached to surfaces whose surface normals pointing away exhibit a component in the direction of the shear force to be transmitted. Structural element 10 as well as the load introduction prevention section is therefore under compressive stress by the shear force to be transmitted. In order to obtain the desired effect of preventing transmission of a component in the direction of the shear force to be transmitted to structural element 10, load introduction prevention section 3 should be compressible when under compressive stress. If the shear force anchor, as shown in FIGS. 1*a*-3, is entirely enclosed by load introduction prevention section 3, then a compression in the direction of the acting shear force is only possible when compressible material is used, because transverse expansions are prevented by the adjacent concrete. For this reason, load introduction prevention section 3 is preferably made of a compressible elastic material. Such elastically deformable and compressible materials are preferably closed-cell foams, which additionally prevent moisture from entering the foam, or even open-cell foams. These foams can be glued to the anchor or even be attached in a self-adhesive manner. Load introduction prevention section 3 is then formed by an elastic layer. The basis for these foams are materials such as polyurethane, TPE, EPDM, PE or melamine resin foam. But soft elastic MS polymers are also conceivable as materials for load introduction prevention section 3. Furthermore, a gel pad having a film with an inner gel core can be glued to the shear force anchor. If load introduction prevention section 3 has the possibility of deforming, if consequently a clearance or a gap between the concrete and the shear force anchor is provided, then plastically deformable materials such as wax can also be used. However, it is also possible to provide load introduction prevention section 3 entirely as a gap between the concrete and the shear force anchor, in which case the shear force anchor would have to be provided with a dissolving material. The embodiments of the load prevention section 3 just described can also be combined in various ways; for example, load introduction section 3 can be provided in sections as a gap between the shear force anchor and the structural element and in sections as closed-cell foam. With a load introduction prevention section 3 provided for a large area in the form of elastic material, sound transmission or vibration between two structural elements, such as a flight of stairs connected to a staircase, can be reduced. The elastic layer dampens the vibrations introduced and significantly reduces the sound transmission to the structural element. For the highest possible sound absorption, it is recommended to cover the largest possible area of the anchor with elastic material. In the embodiment according to FIGS. 1*a*-3, load introduction prevention section 3 is not provided on respective upper surface 65 of load introduction sections 51 and 52 and the adjoining upper surface of the webs. This is for the reason that these surfaces, as shown in FIG. 3, terminate with the structural element surface of structural element 10 and are therefore not in contact with the structural element. Installation positions of the shear force anchor are also conceivable in which respective upper surface 65 of load introduction sections 51 and 52 does not terminate with structural element 10, but a region of rear surfaces 63 of respective load introduction sections 51 and 52 protrudes from structural element 10 and is accordingly not contactable with structural element 10. In these projecting regions of rear surfaces 63, load introduction prevention section 3 is then obsolete, where load introduction prevention section 3 can then be provided in sections on rear surfaces 63.

The other sections of the shear force anchor other than load introduction prevention section 3, i.e. webs 41 and 42, connection section 2 and load introduction sections 51 and 52 with associated load introduction surfaces 61 and 62, are made of more rigid material than load introduction prevention section 3. They are made of plastic material, and preferably of steel. Connection section 2 should be protected against corrosion. Suitable for this are therefore stainless steel or galvanized or chromated steel. Webs 41 and 42 and load introduction sections 51 and 52 can also be made of galvanized steel or of mild steel.

With the configuration of elastic load introduction prevention section 3 and the rigid load introduction section and load introduction surfaces 61 and 62 described, the surface normals of which exhibit a component in the direction of the shear force respectively to be transmitted, a rigid connection under compressive stress of load introduction surfaces 61 and 62 of load introduction sections 51 and 52 to structural element 10 via the load introduction surfaces results, where the shear force to be transmitted is largely introduced via this rigid connection into the structural element and only to a very small extent via elastically deformable load introduction prevention section 3.

The principle is there taken advantage of that, when a force can be transmitted in one direction at several sections to a structural component, then the majority of the force is transmitted at the connection with the greatest rigidity.

The shear force respectively to be transmitted can be transmitted via load introduction sections 51 and 52 in a defined manner on load introduction surfaces 61 and 62 of respective load introduction section 51 and 52 to structural element 10. The shear force anchor therefore comprises load introduction sections 51 and 52, via which it is in contact with structural element 10 and can transmit a force component in the direction of the shear force respectively to be transmitted to structural element 10. On the other hand, all the sections on shear force anchor 1, except load introduction surfaces 61 and 62 of load introduction sections 51 and 52, which can transmit a force component in the direction of the shear force respectively to be transmitted in the particular direction to the structural element, are provided with a layer 3 that covers these sections and that is easily deformable as compared to load introduction sections 51 and 52. Shear force anchor 1 is likewise in contact via this deformable layer 3 with structural element 10, where deformable layer 3 deforms under load on shear force anchor 1 by the respective shear force, and there the shear force respectively to be transmitted is transmitted with a smaller component than through respective load introduction section 51 and 52 to the other body.

Figure 4:
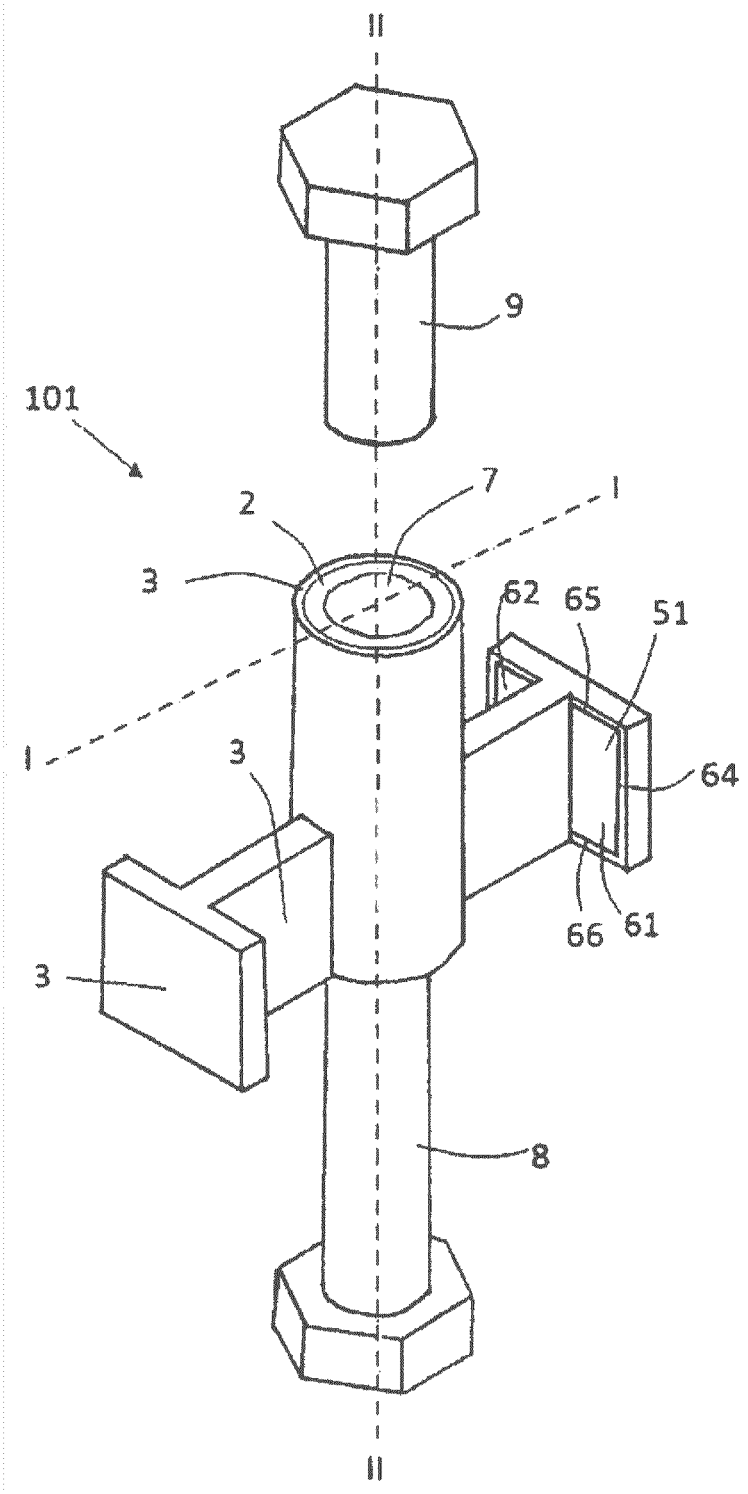
FIG. 4 shows a perspective view of the shear force anchor (101) according to the invention with the load introduction prevention section (3), the anchor bolt (8) and the load introduction bolt (9), and a second embodiment rotated by 180° about axis I-I.

The position of shear force anchor 1 within structural element 10 can vary depending on the configuration. As shown in FIG. 4, shear force anchor 101 is shown in a position rotated by 180° about axis I-I according to a second embodiment, resulting in a deeper position of webs 41 and 42, load introduction sections 51 and 52 and load introduction surfaces 61 and 62. Screwing in anchor bolt 8 and load introduction bolt 9 as well as the principle of load transmission described is analogous to the first embodiment of shear force anchor 1 shown in FIGS. 2 and 3. However, since also respective upper surface 65 of load introduction sections 51 and 52 as well as the respectively adjoining upper surface of the webs would be in contact with the structural element, these surfaces are now as well provided with load introduction prevention section 3. Load introduction prevention section 3 is therefore provided on shear force anchor 101 on all surfaces, with the exception of load introduction surfaces 61 and 62 and the exposed upper surface of sleeve 2, which, when fitted according to FIG. 3, terminates with the structural element surface.

Furthermore, the shape and structural configuration of shear force anchor 1 can vary. Each load introduction section 51 and 52 hitherto had two respective load introduction surfaces 61 and 62, where the two load introduction surfaces 61 and 62 were arranged in a plane and disposed on both sides of respective web 41 and 42. This enables simple production of shear force anchor 1 and a uniform load on the structural element 10. However, more than two load introduction surfaces can also be provided, which need not necessarily lie in one plane. Alternatively, as shown by way of shear force anchor 201 according to a third embodiment in FIG. 5, webs and cylindrical load introduction sections 251 and 252 can be configured as head bolts 14. Each load introduction section then comprises only one respective circular load introduction surface 261. Screwing in anchor bolt 8 and load introduction bolt 9 as well as the principle of load transmission described is analogous to the first embodiment of shear force anchor 1 shown in FIGS. 2 and 3. Load introduction prevention section 3 is provided also on shear force anchor 201 on all surfaces, with the exception of load introduction surfaces 261 and the exposed upper surface of the sleeve.

Figure 5:
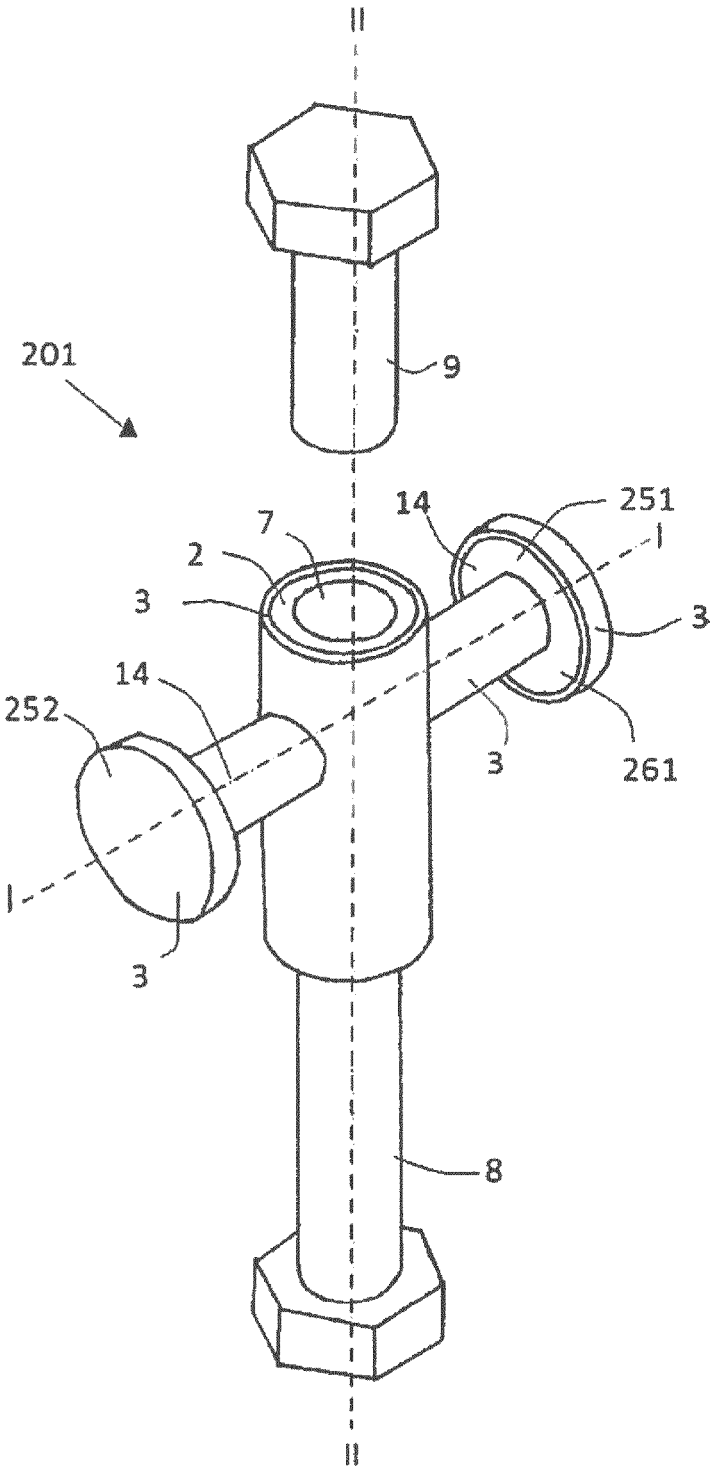
FIG. 5 shows a perspective view of the shear force anchor (201) according to the invention with the load introduction prevention section (3), the anchor bolt (8) and the load introduction bolt (9) in a third embodiment with a head bolt (14)
Figure 6:
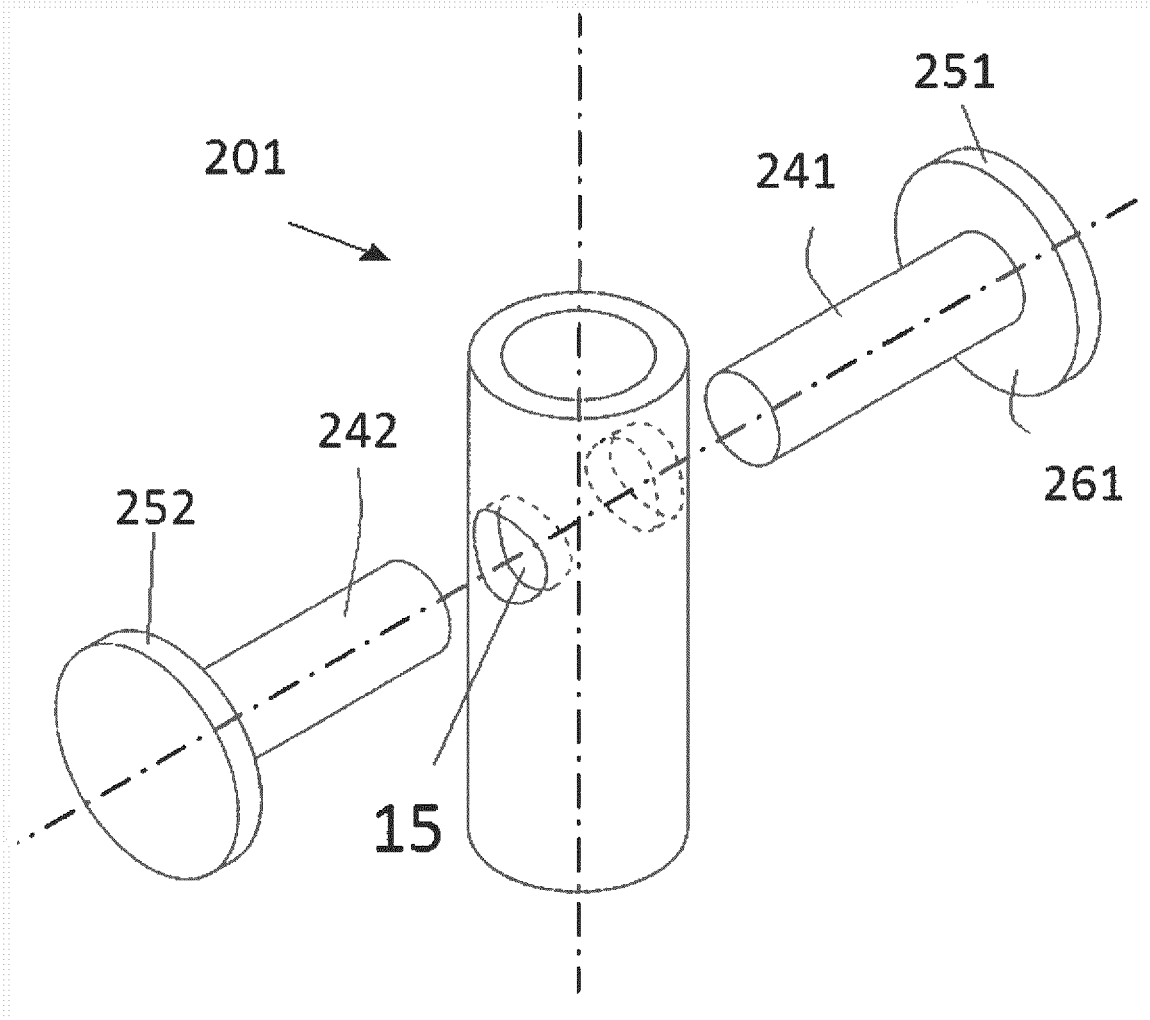
FIG. 6 shows an exploded view of the shear force anchor (201) of the invention according to FIG. 5 without the load introduction prevention section (3), the anchor bolt (8) and the load introduction bolt (9)

FIG. 6 shows an exploded view of shear force anchor 201 from FIG. 5 with head bolt 14, where load introduction prevention section 3 is not shown. Central connection section 2 in the form of a sleeve shows two acceptance points 15 for the webs of head bolt 14, which can be considered either as being weld points or can also represent threads into which the head bolts can be screwed. Webs 241 and 242 can therefore be particularly easily attached to a sleeve located between load introduction sections 251 and 252. Connection section 2 can also be configured in other ways, as long as a connection element can be connected thereto in a positive substance-fit, positive-fit, or force-fit manner for introducing forces into shear force anchor 1. For example, the connection section can also be configured as a flange.

Figure 7A:
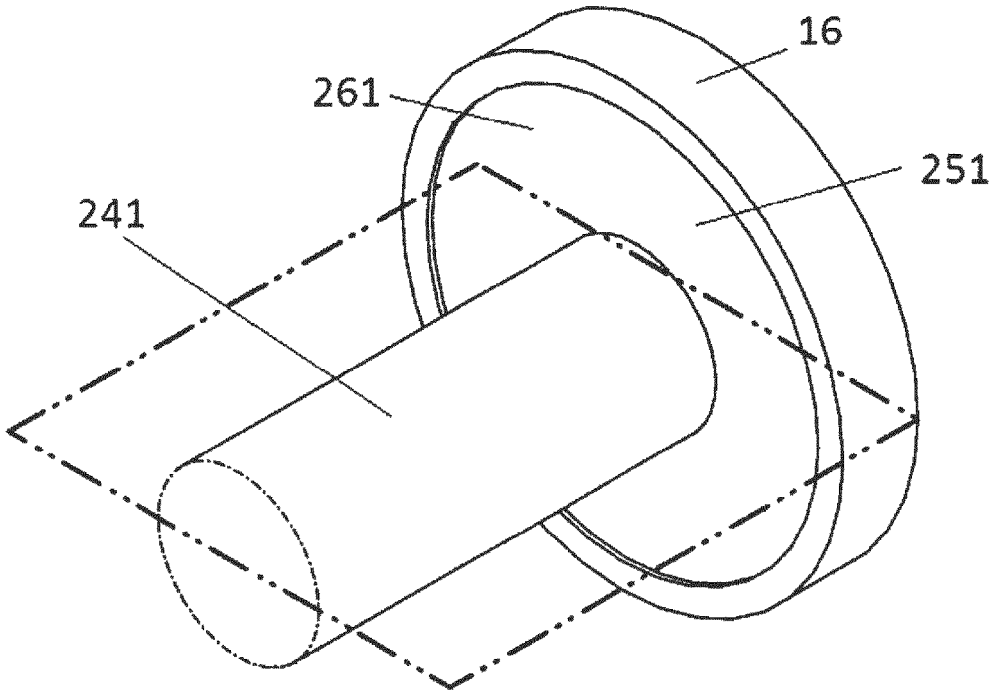
FIG. 7*a* shows a perspective view of a plastic cap (16) as a load introduction prevention section (3)
Figure 7B:
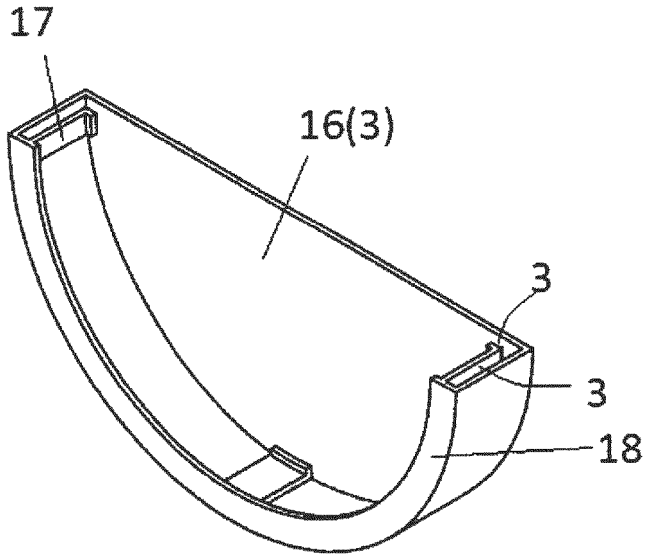
FIG. 7*b* shows a perspective view of a section of the plastic cap (16) according to the sectional plane in FIG. 7*a*.

FIGS. 7*a* and 7*b* illustrate a plastic cap 16 which is suitable as a load introduction prevention section 3 for shear force anchor 201 shown in FIG. 6. FIG. 7*a* there shows first load introduction section 251 connected to web 241 as well as plastic cap 16 attached to the first load introduction section. FIG. 7*b* shows plastic cap 16 in a semi-section according to the sectional plane drawn in in FIG. 7*a*. Such a plastic cap 16 can be provided on load introduction section 251 by way of click elements 17 attached in the interior of the plastic cap in the circumferential direction. Click elements 17 are connected via a web-shaped connection 18 to the outside surface of plastic cap 16. An air gap therefore arises between the base surface of plastic cap 16, which is disposed opposite to rear surface 63 of load introduction section 251, and click element 17, as well as between click element 17 and the outside surface of the plastic cap. This air gap allows for deformation under an acting shear force, for which reason a transmission of a force component in the direction of the shear force to be transmitted is greatly reduced, only via connection 18, which has to enable the deformation, a small force component can be transferred in the direction of the shear force to be transmitted. Plastic cap 16 is therefore one example of a load introduction prevention section in which a gap exists at least in part as load introduction prevention section 3. In this embodiment, plastic cap 16 comprises the integrally formed gap serving as load introduction prevention section 3, and plastic cap 16 itself therefore functions as load introduction prevention section 3. However, as already explained, a gap can be provided between the shear force anchor and the structural element in that, for example, self-dissolving material is applied to the shear force anchor. Such plastic caps can be provided in a similar manner also for other sections of shear force anchor 201, for example, for webs 241 and 242. Such plastic caps can be produced by injection molding, which is why other shapes of the plastic cap can be realized. For example, the plastic cap can also be used for shear force anchors 1 and 102 with cuboid load introduction sections 51 and 52.

Figure 8:
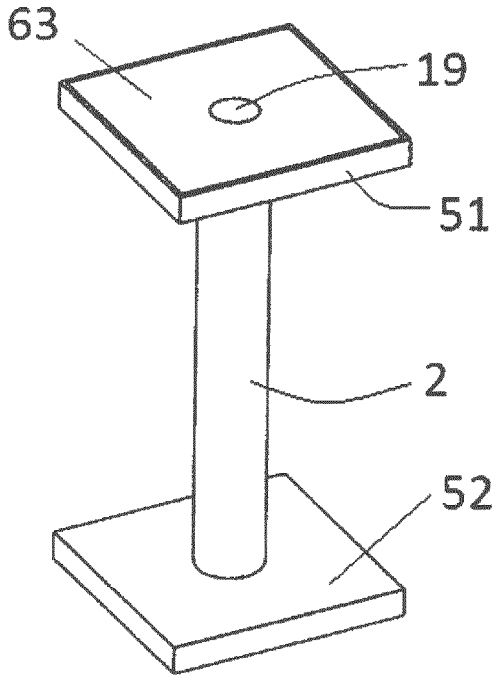
FIG. 8 shows a perspective view of a modified shear force anchor with cuboid load introduction sections similar to the first and second embodiments.

FIG. 8 shows a perspective view of a modified shear force anchor according to the invention, similar to the first and the second embodiment with cuboid load introduction sections 51 and 52. In this type of configuration, two load introduction sections 51 and 52 arranged in parallel are connected, for example, by way of a sleeve-shaped hollow cylinder as connection section 2 with or without an internal thread. A connection element can be provided in connection section 2 by way of a bore 19 in load introduction sections 51 and 52. These anchors can serve, for example, as a connection or punching shear reinforcement for supports, columns, etc. They are also suitable for transmitting opposite shear forces transversely to the structural element longitudinal direction, where the axis of connection section 2 lies in the direction of the shear forces respectively to be transmitted, but the connection section itself is spaced in the direction of the shear force respectively to be transmitted from the respective load introduction sections.

Figure 9:
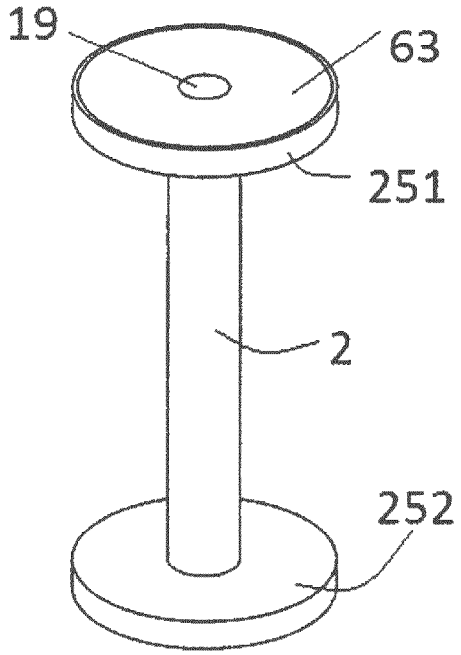
FIG. 9 shows a perspective view of a modified shear force anchor with cylindrical load introduction sections similar to the third embodiment.

FIG. 9 shows a modified shear force anchor according to the invention with cylindrical load introduction sections 251 and 252, similar to the third embodiment. FIGS. 8 and 9 do not show the elastic layer as a load introduction prevention section. Even without an elastic layer, a shear force anchor according to the invention is superior to conventional connection devices, because at least one force component in the direction of the shear force respectively to be transmitted is transmitted to the structural element via a large structural element thickness due to the spacing of the connection section from the load introduction section in the direction of the shear force respectively to be transmitted.

The shear force anchors according to FIGS. 8 and 9 are used as a connection for e.g. punching shear reinforcement. Again, however, a load introduction prevention section in the form of an elastic layer is provided according to the invention. If this anchor is loaded with shear force, then the load introduction surfaces are under compressive stress in the direction in which the shear force acts. In particular at rear surfaces 63 of load introduction sections 51 and 52 or 251 and 252, respectively, this compressive stress is then absorbed via the elastic layers and not introduced into the underlying concrete and a shear punching is more difficult. On the uncoated surface of the load introduction surfaces, the force is introduced directly into the structural element. Due to the deep lying anchor, high forces can be absorbed without shear punching arising.

The shear force anchors according to the invention are also advantageous for lifting and erecting horizontal precast concrete elements. Due to the load introduction areas, the acting shear forces are introduced into the structural element over a large part of the structural element thickness and the concrete can be utilized more effectively without the anchors tearing out of the concrete.

Alternatively, such an anchor can also be provided with more than two load introduction sections, for example, with four. Such an anchor cannot only dissipate shear force along one axis, but along two axes.

LIST OF REFERENCE NUMERALS

1, 101, 201 shear force anchor
2 anchor sleeve (connection section)
3 load introduction prevention section
41, 42, 241, 242 webs
51, 52, 251, 252 first and second load introduction section
61, 62, 261 load introduction surfaces
63 rear surface or surface of a load introduction section facing structural element outer surface
64 side surfaces of a load introduction section
65 upper surface of a load introduction section
66 lower surface of a load introduction section
7 internal thread
8 anchor bolt
9 load introduction bolt
10 structural element
11 left-side outer face
12 right-hand side outer face
13 break-out cone
14 head bolt
15 acceptance points for webs
16 plastic cap
17 click element
18 connection click element
19 bore for connection element

The invention claimed is:

1. A shear force anchor for transmitting shear forces transversely to a longitudinal direction of a structural element within structural elements made primarily of concrete, comprising:

a connection section for introducing at least one shear force into said shear force anchor, where said connection section is a sleeve;

at least one load introduction section connected to the connection section and which can be contacted to said structural element to transmit at least one force component in a direction of the shear force to be transmitted to said structural element, where said connection section is spaced in the direction of the shear force to be transmitted from said load introduction section; and at least one load introduction prevention section, which in part, and preferably entirely, prevents force transmission with a component in the direction of the shear force respectively to be transmitted through the respective load introduction section to said structural element;

wherein said load introduction prevention section is at least in sections provided at said connection section.

2. The shear force anchor according to claim 1, wherein said shear force anchor comprises two load introduction sections for transmitting opposite shear forces, wherein said first load introduction section can transmit a force component to said structural element in one direction of the shear forces to be transmitted, wherein said second load introduction section can transmit a force component to said structural element in the opposite direction of the shear forces to be transmitted and is spaced in the one direction of the shear forces to be transmitted from said first load introduction section, and wherein said connection section is connected to both load introduction sections.

3. The shear force anchor according to claim 2, wherein a web extends from said connection section on two sides and establishes a connection to said respective load introduction sections.

4. The shear force anchor according to claim 3, wherein said connection section, said respective load introduction section, and said webs are made of more rigid material than a material of said load introduction prevention sections.

5. The shear force anchor according to claim 4, wherein said connection section, said respective load introduction section, and said webs are made of galvanized steel.

6. The shear force anchor according to claim 1, wherein said load introduction prevention section is provided in sections at said respective load introduction section.

7. The shear force anchor according to claim 1, wherein said load introduction prevention section is provided spaced in the direction of the shear force respectively to be transmitted from said respective load introduction section.

8. The shear force anchor according to claim 1, wherein the force component to be transmitted from said respective load introduction section to said structural element in the direction of the shear force respectively to be transmitted is greater than a force component to be transmitted in the direction of the shear force respectively to be transmitted from said load introduction prevention section to said structural element.

9. The shear force anchor according to claim 1, wherein said respective load introduction section comprises at least one load introduction surface, which can be contacted to said structural element and whose surface normal pointing away exhibits a component in the direction of the shear force respectively to be transmitted, but wherein said load introduction surfaces of said respective load introduction section are preferably perpendicular to the direction of the shear force respectively to be transmitted, and/or said several load introduction surfaces of said respective load introduction section lie in one plane.

10. The shear force anchor according to claim 9, where said load introduction prevention section is provided at least in sections on all surfaces which are located from said load introduction surfaces of said respective load introduction section in the direction of the shear force respectively to be transmitted and whose surface normals pointing away exhibit a component in the direction of the shear force respectively to be transmitted.

11. The shear force anchor according to claim 1, wherein said load introduction prevention section is provided on all surfaces, except on load introduction surfaces of said respective load introduction section.

12. The shear force anchor according to claim 1, wherein said load introduction prevention section is made of compressible elastic material.

13. The shear force anchor according to claim 12, wherein said compressible elastic material comprises closed-cell foam.

14. A connection structure consisting of a structural element and the shear force anchor according to claim 1, wherein said load introduction prevention section is provided at least in part as a gap between said structural element and said shear force anchor.

15. The shear force anchor according to claim 1, wherein said respective load introduction section comprises at least one load introduction surface, which can be contacted to said structural element and whose surface normal pointing away exhibits a component in the direction of the shear force respectively to be transmitted, but wherein said load introduction surfaces of said respective load introduction section are perpendicular to the direction of the shear force respectively to be transmitted, and/or said several load introduction surfaces of said respective load introduction section lie in one plane.

16. A shear force anchor for transmitting shear forces transversely to a longitudinal direction of a structural element within structural elements made primarily of concrete, comprising:

a connection section for introducing at least one shear force into said shear force anchor, where said connection section is a sleeve;

at least one load introduction section connected to the connection section and which can be contacted to said structural element to transmit at least one force component in a direction of the shear force to be transmitted to said structural element, where said connection section is spaced in the direction of the shear force to be transmitted from said load introduction section; and at least one load introduction prevention section, which at least in part prevents force transmission with a component in the direction of the shear force respectively to be transmitted through the respective load introduction section to said structural element;

wherein said load introduction prevention section is at least in sections provided at said connection section.

* * * * *